US005092712A

United States Patent [19]

Goldman et al.

[11] Patent Number: 5,092,712

[45] Date of Patent: Mar. 3, 1992

[54] INCLINED LEG JACK-UP PLATFORM WITH FLEXIBLE LEG GUIDES

[76] Inventors: Jerome Goldman, 935 Gravier St., New Orleans, La. 70112; Roy M. Bennett, 1901 Lafayette St., Apt., 553, Gretna, La. 70053

[21] Appl. No.: 535,016

[22] Filed: Jun. 7, 1990

[51] Int. Cl.[5] ..... E02B 17/08

[52] U.S. Cl. ..... 405/196; 405/198; 405/227

[58] Field of Search ..... 405/196, 197, 198, 199, 405/200, 211, 227; 114/264, 265

[56] References Cited

U.S. PATENT DOCUMENTS

| | | | |
|---|---|---|---|
| 4,270,877 | 6/1981 | Post | 405/198 |
| 4,318,640 | 3/1982 | Schiemichen et al. | 405/199 |
| 4,479,401 | 10/1984 | Korkut | 405/198 X |
| 4,657,437 | 4/1987 | Breeden | 405/198 |

*Primary Examiner*—David H. Corbin
*Attorney, Agent, or Firm*—Keaty & Keaty

[57] ABSTRACT

The invention relates to an offshore platform assembly which uses inclined legs. The improved assembly provides for the use of a floatable hull which has a plurality of cylindrical wells extending vertically through the hull body and a plurality of legs which are supported by the hull in transit and which support the hull in a working condition. Each chord of the supporting leg passes through a corresponding well formed in the hull and compresses a flexible guide positioned within the well of the hull to reduce the bending moment imposed on the leg during elevation of the hull, induced by the sagging of the hull or by severe storm. The flexible guide has a compressible member which moves laterally, to a limited distance, to absorb the bending moment. The compressible member can be a resilient sleeve, a spring or other laterally movable and adjustable member.

17 Claims, 3 Drawing Sheets

INCLINED LEG JACK-UP PLATFORM WITH FLEXIBLE LEG GUIDES

BACKGROUND OF THE INVENTION

The present invention generally relates to offshore platform assemblies, such as self-elevating marine vessels known as jack-up platforms which are adapted to be deployed in a body of water. More particularly, the present invention relates to a platform assembly with inclined, movable legs which can be lowered to the sea bottom to support the platform over a body of water and which are raised for transit of the platform.

Jack-up floating platforms are the most common type of movable offshore drilling units. Such units were first used in the 1950's and today account for approximately 500 such vessels in the worldwide service. As a general rule, these rigs have three or more legs, which are perpendicular to the hull and which are jacked down to the sea floor and are fixed at the sea floor, after which time the platform hulls are lifted above the wave action of the seas.

Another type of jack-up rigs or platforms utilizes inclined, or slanted legs.

The platforms of the second type are deployed in deep waters (250 feet and greater) and therefore their legs have a relatively greater length than the platforms in shallow waters. Therefore, the legs are often positioned outward from the platform at a small angle, for example 1 to 10 degrees, or even more, from the vertical, so as to provide a larger foundation area for the erected platform. The platform, when in installed position, has a symmetrical arrangement and affords considerable rigidity and resistance to overturning, bending forces caused by wind, wave and current.

The operational experience with this type of rig was very good, once they had been jacked-up on a drilling location. However, the tilting mechanism proved to be a source of great difficulty during jacking operations. Such factors as safety, high maintenance costs and high initial costs proved prohibitive in manufacturing and deploying more than a few of such platforms worldwide. The tilting mechanisms employed in the past are massive pieces of machinery and structure. While a few such units still exist, non have been built since 1976 because of high cost and poor safety considerations.

A special concern was caused by the bending moment on the legs while the platform was being erected above the sea level, since rigid guides within which the legs were received, exerted considerable bending loads and shear forces into the legs. Since the leg bottoms are fixed at the sea bottom while the hull is afloat and during the hull lifting action, the legs support the hull weight as the hull is elevated to its desired drilling height and the leg guides gradually impose increasing bending loads in the legs and increasing reaction forces in the guides, most particularly in the lower guides. Such forces induce high stress levels in legs and guides even to the degree that the structure may fail.

The present invention contemplates provision of a jack-up platform having inclined legs, wherein the bending loads and shear forces on the supporting legs are considerably reduced and minimized, thus eliminating the major drawback associated with the prior art. Tilting structures and mechanisms are not employed in this invention.

SUMMARY OF THE INVENTION

It is therefore an object of the present invention to provide a jack-up platform which allows elevation of a platform hull along the supporting legs, while considerably reducing and minimizing bending loads on the legs.

It is another object of the present invention to provide a jack-up platform for use with inclined legs structure, wherein at least the lower guides are adapted to accept horizontal forces.

It is a further object of the present invention to provide an inclined leg jack-up platform which has flexible leg guides which are adapted to move laterally, to some degree, absorbing much of the bending loads and shear forces imposed on the legs.

These and other objects of the present invention will be more apparent to those skilled in the art from the following description of the invention.

The objects of this invention are achieved by providing an offshore platform assembly which comprises a floatable hull having a plurality of cylindrical wells extending vertically therethrough.

Mounted in each well and securedly attached to the annular wall of each well is a flexible guide which receives one of the leg chords of the supporting legs. Each flexible guide has a compressible member formed as a resilient vertical rectangular sleeve, a spring or other adjustable means which permits a limited lateral movement of the guide to absorb a force due to the bending moment acting on the leg which passes through the guide in the hull. The force absorbed by the flexible guide can be exerted during elevation of the hull to a working height above the water surface, by hull sagging or by storm, all imposing substantial bending moments on the legs at a point where the leg passes through the well of the hull, since the distance between the wells is a fixed distance and the position of the legs on the bottom floor is also fixed.

These and other features of the invention will be more apparent to those skilled in the art from the following description of the invention.

BRIEF DESCRIPTION OF THE DRAWINGS

Further objects and advantages of the invention will be more apparent from the study of the following detailed description and the accompanying drawings, wherein.

DETAILED DESCRIPTION OF THE PREFERRED EMBODIMENT

Figures 1, 2, 3, 4:
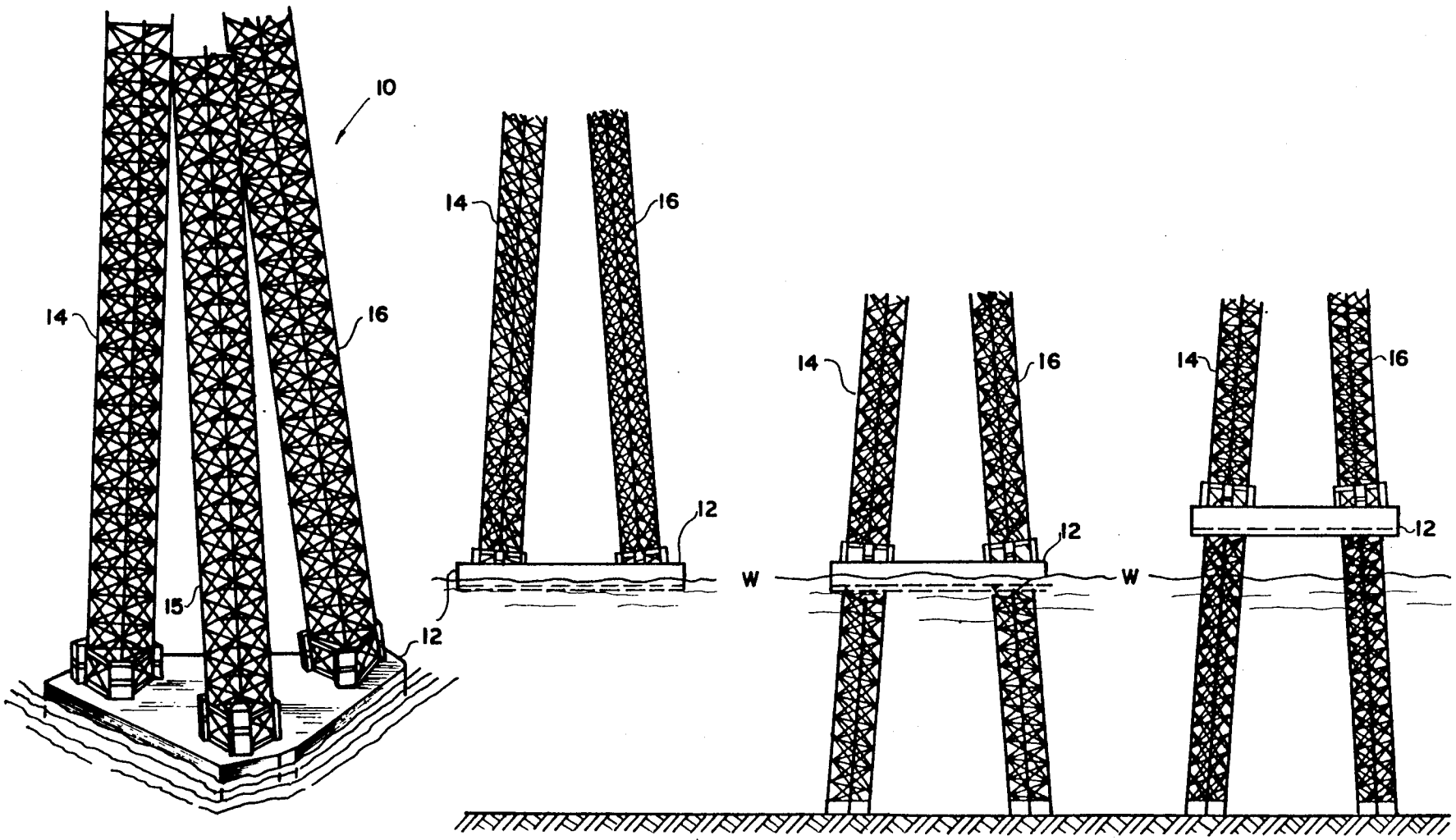
FIG. 1 is a schematic view of an offshore platform assembly, with the legs elevated while the assembly is afloat.
FIG. 2 is a side view of the platform illustrating two aft legs, with an assembly afloat.
FIG. 3 is a side view of the platform assembly, with the legs lowered to the ocean bottom and the platform hull afloat.
FIG. 4 is a side view, with the legs secured to the ocean bottom and the platform hull elevated to a working position.

Reference will now be made to the drawings, wherein like parts are designated by like numerals, and wherein numeral 10 designates a jack-up platform assembly. The assembly 10 comprises a floating hull which may be of a generally triangular configuration. The assembly 10 also includes three legs 14, 15 and 16 which are located at three approximately equally spaced points on the body of the hull 12 and which extend upwardly from the hull 12 during transit. Each leg 14–16 can be generally eqilaterally triangular in cross-section or rectangular in cross-section, as the case may be. The number of legs illustrated in FIG. 1 is exemplary and four-leg assembly can be also employed with inclined leg jack-up platforms.

Each leg 14, 15 and 16 comprises a rigid frame fabricated of a plurality of steel members including three elongated beams which are symmetrically arranged about a central axis. The elongated beams are joined together and maintained in a triangular array by a plurality of interconnected cross braces, as schematically shown in the drawings.

The elongated beams or leg chords of each leg are provided with a plurality of vertically spaced teeth which engage the associated jack-up and fixation unit.

Figure 6:
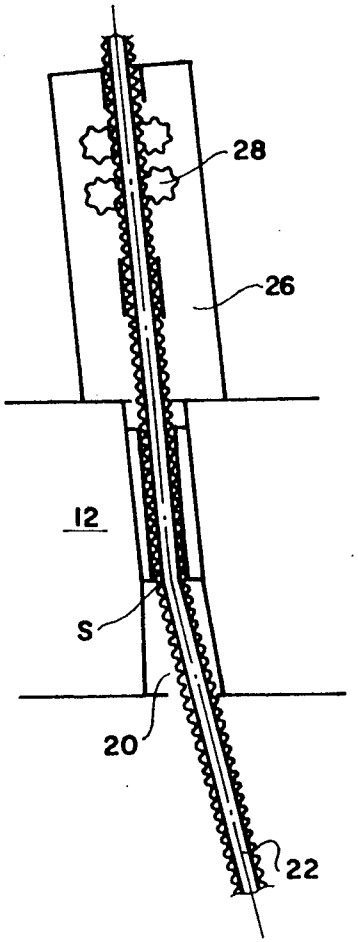
FIG. 6 is a schematic view showing movement of the hull along the leg and a sharp bend caused in the leg structure by a rigid lower guide.

Referring to FIG. 6, the hull 12 is seen to be provided with a well 20 which extends vertically or at a slightly angular position to the vertical, through the hull 12. FIG. 6 illustrates one of the leg chords 22 extending through the well 20 from a position below the hull 12 to a position above the hull.

Figure 11:
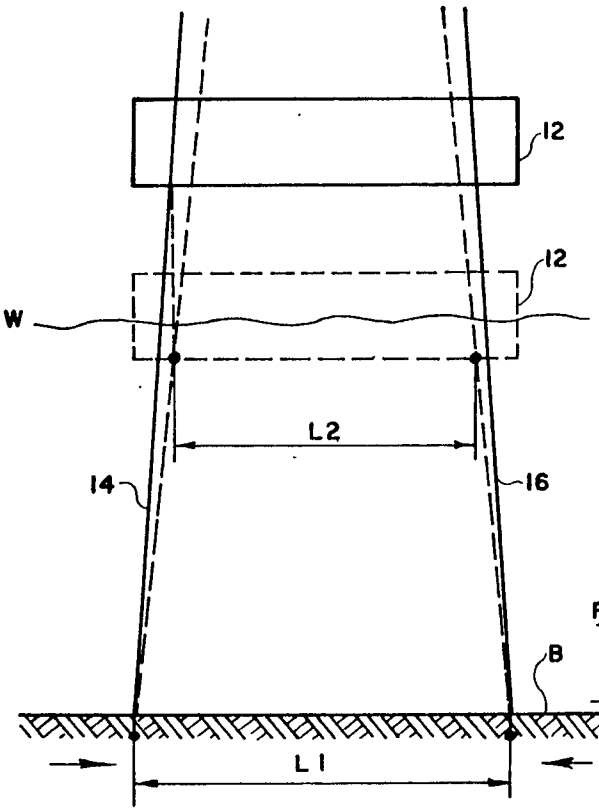
FIG. 11 is a schematic view of the conditions affecting the legs during elevation of the hull above the water surface.

Reference will now be made to FIG. 11 which graphically illustrates the position of the legs when the hull 12 is jacked-up to working height of approximately 68 feet above the water line. Prior to elevating the hull, the legs 14, 15 and 16 of the platform assembly are embedded or otherwise fixedly installed on the ocean bottom B. The distance L1 between the legs therefore becomes a fixed dimension. The distance between the wells 20 formed in the hull 12 is also fixed and designated by L2 in FIG. 11. The transit position of the hull 12 is illustrated in phantom lines in FIG. 11. As the hull 12 is elevated or jacked-up above the water line W, the distances L1 and L2 remain fixed. Therefore, the legs 14 and 15 must bend in order to accommodate the fixed distance between the legs passing through the wells 20. The final working position of the hull 12 and the legs 14 and 16 is illustrated in solid lines in FIG. 11.

Figure 12:
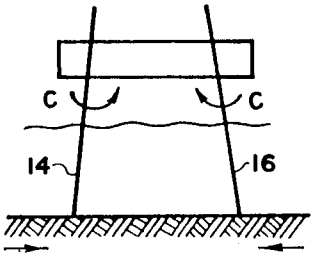
FIG. 12 is a schematic view illustrating bending moments in the legs when the hull is being jacked up to working height.
Figure 13:
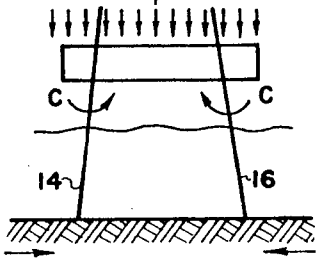
FIG. 13 is a schematic view illustrating bending moment imposed on the legs due to hull sagging.
Figure 14:
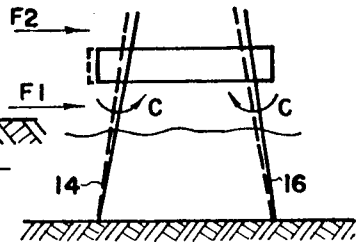
FIG. 14 schematically illustrates bending moment imposed in the legs due to 50 year storm condition.

Referring now to FIGS. 12 through 14, the leg loads will be addressed. As shown in FIG. 12, the bending moment is introduced into the legs 14 and 16 due to the hull 12 being jacked-up to a working height. FIG. 13 illustrates the bending moment imposed on the legs 14 and 16 due to hull sagging, the forces being illustrated by arrows A in FIG. 13. FIG. 14 illustrates additional bending moment imposed on the legs due to 50 year storm condition, the motions of waves and the force of wind which is respectively illustrated by arrows F1 and F2, respectively. The bending moments exerted on the legs are illustrated by arrows C in FIGS. 12–14. The direction of the bending moment of FIG. 14 will be reversed if the storm approaches from right to left, that is from the direction of leg 16 towards leg 14.

It was determined that the bending moment in a leg due to the hull being jacked to a working height (shown in FIG. 12) approximates 247,390K. ft. for rigid guides. In comparison, the flexible guides allow a reduction in the bending moment in a leg due to the hull being jacked-up to a working height to about 137,439K. ft. The bending moment in a leg due to hull sagging (FIG. 13) approximates 63,560K. ft. when using rigid guides and is reduced to 42,373K. ft. with flexible guides. Bending moment in a leg due to the 50 year storm condition approximates 892,514K. ft. with rigid guides and is the same value of 892,514K. ft. with flexible guides. The 50 year storm condition was calculated based on 361 feet water depth, 94 feet wave height, 1.53 Kt current and 87.3Kt wind velocity.

As a result, a total bending moment in a leg 14–16 equals bending moments introduced through the leg being jacked-up, due to hull sagging and 50 year storm condition and equals 1203464K. ft. in a leg with rigid guides and is reduced to 1072326K. ft. in a leg with flexible guides.

It was determined that the total bending moment in a leg produces a bracing stress of 65 ksi when a rigid guide is used and is reduced to 40 ksi when flexible guides are employed.

Figure 15:
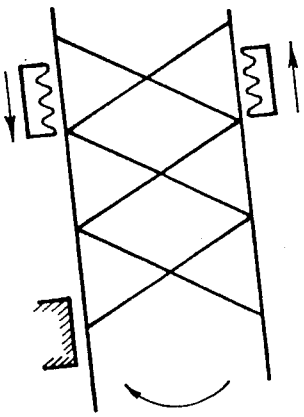
FIG. 15 schematically illustrates the way the leg bending moment is reacted due to a storm.
Figure 16:
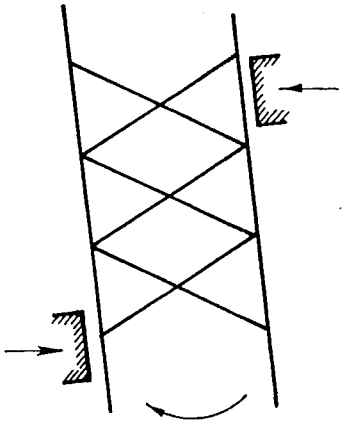
FIG. 16 schematically illustrates the way the leg bending moment is reacted due to jacking up of the hull and hull sagging.

Referring now to FIGS. 15 and 16, the bending moment on a leg can be clearly seen as reacted by a rack chock in FIG. 15 and as reacted by rack guides in FIG. 16.

The direction of arrows in FIG. 15 illustrates the direction of forces imposed on a leg during storm conditions. The direction of arrows in FIG. 16 illustrates the direction of forces imposed on a leg during jacking up and hull sagging. It was determined that using rigid guides, the bracing stress is about 5 ksi due to storm conditions and 60 due to jacking-up and hull sagging. As a result, the total bracing stress affecting the leg is calculated to be 65 ksi. As was recommended by the American Institute of Steel Construction Code, the bracing axial allowable stress is 53 ksi. It is clearly seen that the actual stress in the bracings using a rigid guide is beyond the allowable limit. In contrast, the flexible guide configuration gives a bracing stress due to storm conditions of 5 ksi and a reduction in the bracing stress due to jacking-up and hull sagging to 35 ksi total, with a total bracing stress being 40 ksi for flexible guides, which brings it within allowable limit.

Referring now with more detail to the structure of the flexible guides, reference will be made to FIGS. 1 through 10.

Positioned within the well 20 is a vertical lower guide 24 which assists in guiding of the leg chord 22 through the well 20, to prevent the leg 16 from engaging the walls of the hull 12 which defines the well 20.

An inclined jacking unit 26 is carried by the hull 12 in alignment with the well 20, the jacking system having engagement and fixation elements 28 which are provided with matching teeth for engagement with the teeth of the leg chord 22.

During transit, the unit 10 is transported to a preselected location with the legs 14, 15 and 16 being elevated, or retracted, as shown in FIGS. 1 and 2. Once arrived at a certain location, wherein drilling operations are to be conducted, the legs 14–16 are lowered through the wells 20 until they reach the bottom of the body of water, while the hull 12 is afloat. This position is illustrated in FIG. 3 of the drawings. The legs 14–16 are secured to the ocean floor and are partially embedded therein, so that the position of the legs is fixed.

Following fixation of the legs, the hull 12 is raised or jacked-up above the sea level to a height sufficient to remove the hull 12 from the wave action zone under normal sea conditions. This position of the hull is illustrated in FIG. 4 of the drawings.

Figure 5:
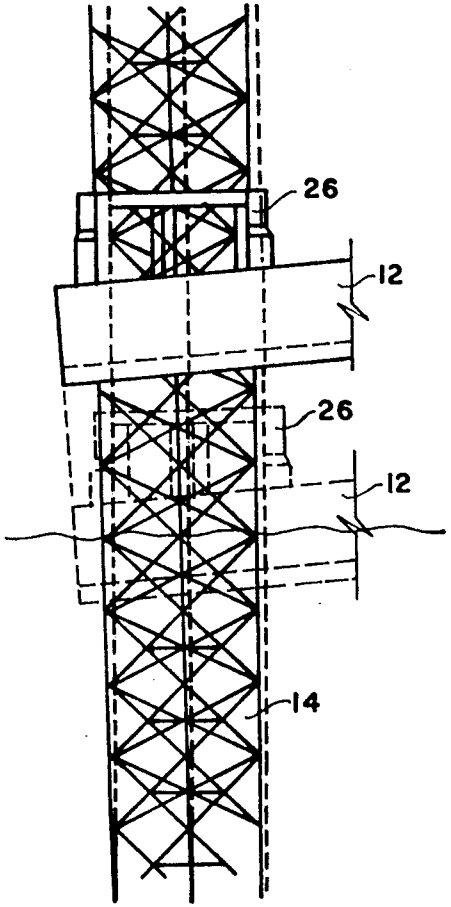
FIG. 5 is a detail view of one of the legs, with a lower position of the hull being illustrated in phantom lines and the hull in the elevated position being schematically illustrated in solid lines.

Referring now to FIG. 5, a detailed view of one of the legs being affected by bending loads during elevation of the hull 12 is illustrated. As can be seen in the drawing, the hull 12 is elevated generally perpendicular to the water line W, while the leg 14 tends to retain its inclination. For the purpose of illustration an inclination angle approximating 5 degrees is used in the drawings. As will be appreciated, the bottom of the leg is fixed to the ocean floor and the hull 12 is essentially rigid, while the leg 14, in contrast, is relatively flexible, having an open framework structure. The well 20 formed in the hull 12 is of a prescribed diameter and causes the leg to conform to its general orientation. Such action puts a bending moment into the leg, as the hull 12 acts to reduce an angle of the leg slope during the elevation of the hull 12, due to hull sagging or storm conditions.

Additionally, the legs 14, 15 and 16 support the weight of the hull 12 during jacking operation by engagement of the teeth of the leg chords 22 with the teeth of the gearing or jacking system 26. The "dead weight" of the hull 12 forces the bottoms of the legs 14, 15 and 16 into the ocean floor.

Referring again to FIG. 6, the bending force imposed on the leg chord 22 is seen in creation of the sharp bend S at the level of contact of the leg chord 22 with the lower guide 24. The actual bend can vary, depending on many conditions and the bend illustrated in FIG. 6 is an exemplary view of the resultant effect of the bending load.

Figure 8:
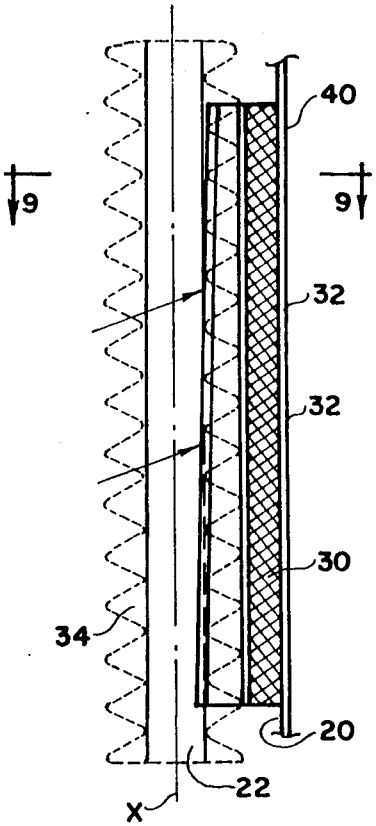
FIG. 8 is a detailed view illustrating movement of the flexible lower guide of the present invention and one of the leg chords.
Figure 7:
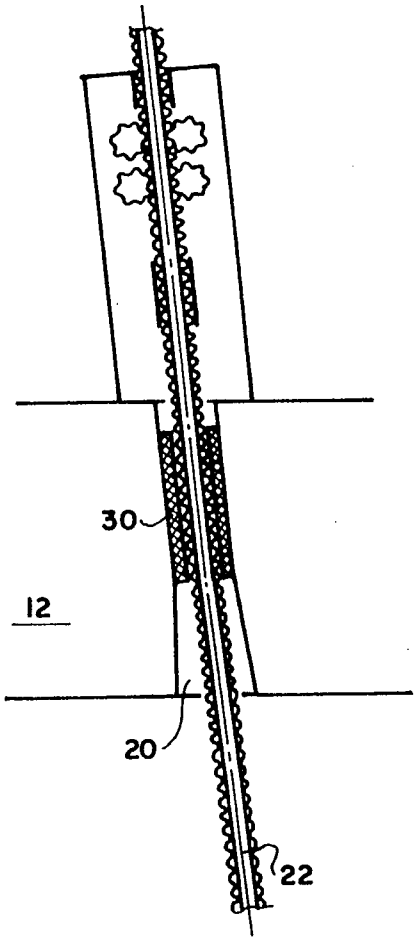
FIG. 7 is a schematic view of the leg utilizing the flexible lower guides of the present invention.

Turning now to FIGS. 7 and 8, an improved flexible guide design of the present invention is illustrated. As seen in the drawings, the leg chord 22 is received within the well 20 formed within the hull 12 and is guided through the well 20 by a lower guide 30. The guide 30 is a vertical guide having a front wall 32 which engages the teeth 34 of the leg chord 22. The front wall 32 is smooth and is formed from a strong material capable of withstanding frictional forces imposed by the movement of the hull 12 along the leg chord 22.

"Sandwiched" between the wall 36, which defines the well 20 of the hull 12, is a flexible resilient insert 40 which extends through substantially the entire length of the guide 30. The resilient insert 40 is fixedly attached to the side of the front wall 32 opposite the contact surface and is fixedly attached to the wall 36 of the well 20.

Phantom lines in FIG. 8 illustrate position of the lower guide 30 before the hull 12 is elevated above the water level W. As can be seen, the front wall 32 of the guide 30 occupies a position within the well 20 closer to the vertical axis of the well 20, with the resilient insert 40 forcing the wall 32 inwardly.

After the hull 12 is elevated from the water, the teeth 34 of the leg chord 22 contact the front wall 32 and, during elevation process, compress, the insert 40, moving the wall 32 away from the longitudinal axis X of the well 20. The position of the lower guide 30 during elevation of the hull 12 is illustrated in solid lines in FIG. 8. Due to resiliency and flexibility of the insert 40 the leg chord 22 laterally moves the lower guide 30, eliminating or substantially reducing the bending force exerted on the leg chord 22. As a result, the leg chord 22 can still bend, to some degree in a more gently curve, as compared to the prior art bending, while still being restrained by the compressed guide 30.

Figure 9:
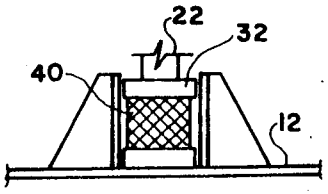
FIG. 9 is a cross-sectional view along lines 9—9 of FIG. 8 illustrating the flexible guide of the present invention before compression.
Figure 10:
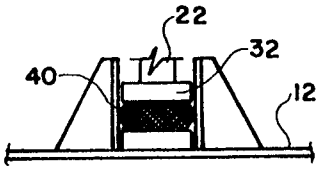
FIG. 10 is a cross-sectional view similar to FIG. 9, but with a lower guide being compressed.

Referring to FIG. 9, the sectional view of the flexible lower guide 30 is illustrated for a better understanding of the compression capabilities of the guide 30. In FIG. 9 the flexible insert 40 is non-compressed, forcing the front wall 32 towards the center of the well 20. FIG. 10 illustrates compression of the flexible insert 40 under the horizontal loads imposed by the leg chord 22 on the guide 30.

The use of the flexible lower guide allows to secure the advantages of inclined legs jack-up platform, while retaining the safety, simplicity, and lower cost of a vertical leg system. The use of the compressible resilient material 40 in the embodiment described in the present invention is exemplary. The use of spring or other adjustable means is envisioned to allow the guides to move laterally in a horizontal plane under increasing loads from the legs. In the typical case, the guides are designed to be compressed in the range of 3 to 6 inches, although the amount of compression can be greater or smaller, depending on the specific jack-up design. While the use of the lower flexible guides was described above, under certain circumstances it may be desirable to provide similar flexibility in the upper guides, as well. The compression distances will be usually less than for the lower guides, however the method of obtaining flexibility will follow the same principles.

The advantages of the flexible leg guides allow to provide greater safety during elevating and lowering operations of the hull. The only moving elements are guide plates 32 which are mounted on flexible pads 40, which provides greater reliability of the overall design, since there is no complex tilting mechanism. The maintenance and construction costs are also substantially reduced.

While only one embodiment was described and illustrated above, it is understood that numerous modifications and changes can be readily made by those skilled in the art. We therefore pray that our rights to the present invention be limited only by the scope of the appended claims.

We claim:

1. An offshore platform assembly, comprising:

a floatable hull having a plurality of wells extending vertically therethrough;

a plurality of inclined supporting legs secured to the hull and movable between a first, retracted position and a second, hull supporting position;

a plurality of flexible guide means for absorbing bending moments and forces acting on a leg chord of a corresponding leg which moves though a flexible guide means during elevation of the hull, each of the guide means being positioned in a corresponding well of the hull;

means for elevating said hull with respect to said supporting legs; and wherein each of said flexible guide means is movable to a limited degree along a horizontal plane to absorb bending moments and forces acting on a corresponding leg while the hull is being elevated to an operating level.

2. The assembly of claim 1, wherein each of said flexible guide means comprises a compressible member, having an outer and an inner surface, and a flat vertically oriented contact plate which is securedly attached to an inner surface of the compressible member.

3. The assembly of claim 2, wherein said compressible member is a vertically oriented resilient insert having an outer surface securedly attached to an annular wall formed in the well of the hull.

4. An offshore platform assembly, comprising:

a floatable hull having a plurality of wells extending vertically therethrough;

a plurality of inclined supporting legs secured to the hull at an angle away from vertical, each leg having a bottom portion which is adapted to be set on a sea bottom in a substantially stationary position to support the hull;

a plurality of flexible guide means for absorbing bending moments and forces acting on the legs which moves through a corresponding flexible guide means during elevation of the hull, each guide means being positioned within a corresponding well of the hull, each leg passing through a corresponding flexible guide means;

means for elevating said hull to an operational position with respect to the supporting legs; and wherein each of said guide means comprises a compressible member for substantially reducing bending moments acting on a corresponding leg when the hull is elevated to a position to be supported by the supporting legs.

5. The assembly of claim 4, wherein the flexible guide means moves laterally, to a limited degree, under a compression force induced by the supporting leg.

6. The assembly of claim 4, wherein each of the flexible guide means comprises a non-compressible vertically oriented contact plate attached to the compressible member and contacting the supporting leg.

7. The assembly of claim 4, wherein said compressible member is formed from a resilient material.

8. The assembly of claim 6, wherein said compressible member is a resilient insert positioned between the hull and the contact plate in the well of the hull and extending substantially through entire vertical length of the flexible guide.

9. An offshore platform assembly, comprising:

a floatable hull having a plurality of wells extending vertically therethrough;

a plurality of flexible guide means for absorbing bending moments and forces acting on supporting legs during elevation of the hull, each guide means being positioned within a corresponding well of the hull and comprising a compressible resilient member and a vertically oriented contact plate secured to the compressible resilient member, said contact plate having an inner contact surface;

a plurality of inclined supporting legs secured to the hull at an angle away from vertical, each leg having a bottom portion which is adapted to be fixedly connected to a sea bottom to support the hull, each leg passing through a corresponding flexible guide means and contacting the inner surface of the contact plate;

means for elevating said hull to an operational position with respect to the supporting legs; and wherein each of said flexible guide means moves laterally, to a limited degree, under the force of the leg acting on the contact plate and compressing the compressible resilient member during elevation of the hull to the operational position.

10. The assembly of claim 9, wherein said compressible resilient member is a resilient vertically oriented insert positioned between the hull and the contact plate in the well of the hull.

11. The assembly of claim 10, wherein said contact plate is a vertically oriented insert fixedly attached to the compressible resilient member.

12. The assembly of claim 11, wherein said compressible resilient insert is securedly attached to an annular wall of the well extending through the hull.

13. A method of elevating an offshore platform assembly to an operational position, comprising the steps of:

providing a floatable hull having a plurality of wells extending vertically therethrough;

providing a plurality of supporting legs secured to the hull and movable between a first, retracted position and a second, hull supporting position;

providing a plurality of flexible guide means, each positioned in a corresponding well of the hull and receiving at least a portion of a supporting leg therethrough, said flexible guide means being movable to a limited degree along a horizontal plane;

proving means for elevating said hull with respect to said supporting legs;

elevating said hull by said elevating means;

causing said supporting legs to contact said flexible guide means and move the means along the horizontal plane, such that the guide means substantially absorbs a significant portion of bending moments and forces acting on the legs during elevation of the hull.

14. The method of claim 13, wherein each of said guide means comprises a compressible member having an outer and an inner surface, and a flat, vertically oriented non-compressible contact plate which is securely attached to an inner surface of the compressible member and contacts the supporting leg.

15. The method of claim 14, wherein said compressible member is a vertically oriented resilient insert having an outer surface securely attached to an annular wall formed in the well of the hull.

16. The method of claim 13, wherein said supporting legs are inclined legs secured to the hull at an angle away form vertical.

17. The method of claim 13, wherein said hull is elevated to the operational position after the supporting legs are set on a sea bottom in a substantially stationary position to support the hull.

* * * * *